US007201536B1

(12) United States Patent
Westbrook et al.

(10) Patent No.: US 7,201,536 B1
(45) Date of Patent: Apr. 10, 2007

(54) ROAD PATCHING EQUIPMENT

(76) Inventors: Mark Westbrook, 2627 Meadow La., Benton, AR (US) 72015; Micky Wayne Simpson, 7824 Fallen Oaks La., Benton, AR (US) 72015

( * ) Notice: Subject to any disclaimer, the term of this patent is extended or adjusted under 35 U.S.C. 154(b) by 0 days.

(21) Appl. No.: 11/230,198

(22) Filed: Sep. 20, 2005

(51) Int. Cl.
*E01C 19/26* (2006.01)

(52) U.S. Cl. ..... 404/108; 404/133.05

(58) Field of Classification Search ..... 404/101, 404/102, 107, 108, 109, 110, 133.05
See application file for complete search history.

(56) References Cited

U.S. PATENT DOCUMENTS 3,217,620 A * 11/1965 Mindrum et al. ..... 404/90
3,820,914 A * 6/1974 Zimmerman ..... 404/110
4,676,689 A * 6/1987 Yant ..... 404/110
4,830,533 A * 5/1989 Miller ..... 404/101
5,131,788 A * 7/1992 Hulicsko ..... 404/108
5,251,999 A * 10/1993 McCracken ..... 404/109
5,263,790 A * 11/1993 Bickley et al. ..... 404/107
5,333,969 A * 8/1994 Blaha et al. ..... 404/91
5,419,654 A * 5/1995 Kleiger ..... 404/101
5,752,782 A * 5/1998 Hulicsko ..... 404/103

* cited by examiner

*Primary Examiner*—Gary S. Hartmann
(74) *Attorney, Agent, or Firm*—Dennis B. Haase

(57) ABSTRACT

An improved asphalt patching machine which is mountable to a motor vehicle having a supply of asphalt patch material thereon. The patching machine comprises a dispensing and finishing assembly fed by a multi-part, articulatable conveyor which feeds asphalt patching material to the dispensing and finishing assembly, which is movable in substantially the plane of the roadway, to position the dispensing and finishing assembly over the effected area to be patched. The machine first deposits patching material in the effected area and, thereafter, from the dispensing and finishing assembly, integrates the patch into the existing surrounding roadway.

17 Claims, 4 Drawing Sheets

ROAD PATCHING EQUIPMENT

The present invention relates generally to the business of repairing asphalt pavement and, more particularly, to mechanical devices for the patching of potholes, cracks and other imperfections in the asphalt surface.

BACKGROUND OF THE INVENTION

1. Field of the Invention

Asphalt is an obvious staple of the road builder. Despite its durability under load, it is susceptible to the vagaries of changing weather conditions and temperature, which results in expansion and contraction of the surface.

In areas where the temperature can reach effective, if not actual, freezing levels and, when moisture is present, whether from rain, dew or fog, the rate of expansion of water in cracks, or in areas adjacent the lateral edges of the roadway, may exceed that of the road material. As a result, cracks are generated and pieces of asphalt material can literally be lifted from the roadway.

Repeated flexing due to loads running over the roadway also creates cracks, which may eventuate in the lifting and tearing of pieces of asphalt. The inevitable consequence is the enemy of every car's wheels, tires and suspension, the pothole.

The driving public is increasingly vocal about the condition of the roadways upon which they travel, and government, while attempting to respond, is typically under capitalized, understaffed and under equipped to meet the problem as and where it occurs.

In many communities, government has attempted to kill two birds with one stone by acquiring paving equipment which will lay blacktop the width of a full lane of traffic and hope to use the same rig for repairs. Sadly, one size does not always fit all and most paving equipment is very large, expensive to operate in terms of dollars and man power, and often cumbersome to move about even if it were not.

What those whose task it is to effect asphalt repairs want, and what the present invention uniquely provides, is a highly efficient and maneuverable device for effecting small repairs wherever they occur in a highly cost effective manner.

2. Overview of the Prior Art

Since the memory of man runneth not to the contrary, the patching of asphalt is a labor intensive, and often short term, effort. Who among us has not seen a road crew behind a dump truck with asphalt simmering in the bed. With shovels and brooms in hand the crew fills the area to be patched and, in more modern times, a hand-held tamper of sorts is sometimes used to compact the patch.

The patent art includes several more sophisticated and less labor intensive examples, among them Miller U.S. Pat. No. 4,830,533, which discloses a patching machine which depends from a truck and uses a telescoping conveyor to deliver patching material to a bucket and then a spreader, both of which are on a turntable, rotatable on a vertical axis through 360°. Miller also provides a platform for the operator. Miller lacks the versatility of the present invention in that it can not position the spreader relative to the effected area without positioning the truck in order to locate the conveyor precisely over the effected area.

Other patents of some general interest include Hulicsko U.S. Pat. No. 5,131,788 and Gabriel Jr. U.S. Pat. No. 4,215,949 which use a tamping device, and both drop patching material from a truck hopper. Sterner U.S. Pat. No. 4,678,363 drops material from a bin and sprays binder on it. In his U.S. Pat. No. 4,511,284, he uses air to clean the effected area before dropping material through a manually manipulatable chute. Still other device provides a heater and/or scraper to finish a patch, and several other patents disclose various patching devices over which the present invention constitutes a marked improvement.

SUMMARY OF THE INVENTION

Having described the environment in which the present invention has particular utility, it will appreciated that the first objective of the present invention is to provide both the public and private sector with a system for permanently fixing potholes, cracks and the like in asphalt roadways wherever the appear.

It is a further objective of the present invention, in accomplishing the foregoing, to provide a machine which is highly portable and requires minimal man hours to operate. More specifically, it is an objective to provide a device as described which is attachable to a motor vehicle, and which is readily manipulated from its position of attachment to accomplish the filling, and finishing, of patches to effected areas of asphalt which are damaged, whether by weather, repeated heavy moving loads or a combination of those or other conditions.

It is yet another objective of the present invention to provide a device for effecting the patching and finishing of asphalt in multiple locations wherever situate on a lane of a roadway from a single vehicle parked in proximity to the patches.

The foregoing, as well as several other objectives and advantages of the present invention will become apparent to those skilled in the art from a reading of the following Detailed Description of a Preferred Embodiment, taken in conjunction with the drawings, wherein:

DETAILED DESCRIPTION OF A PREFERRED EMBODIMENT

Figures 1, 2, 3:
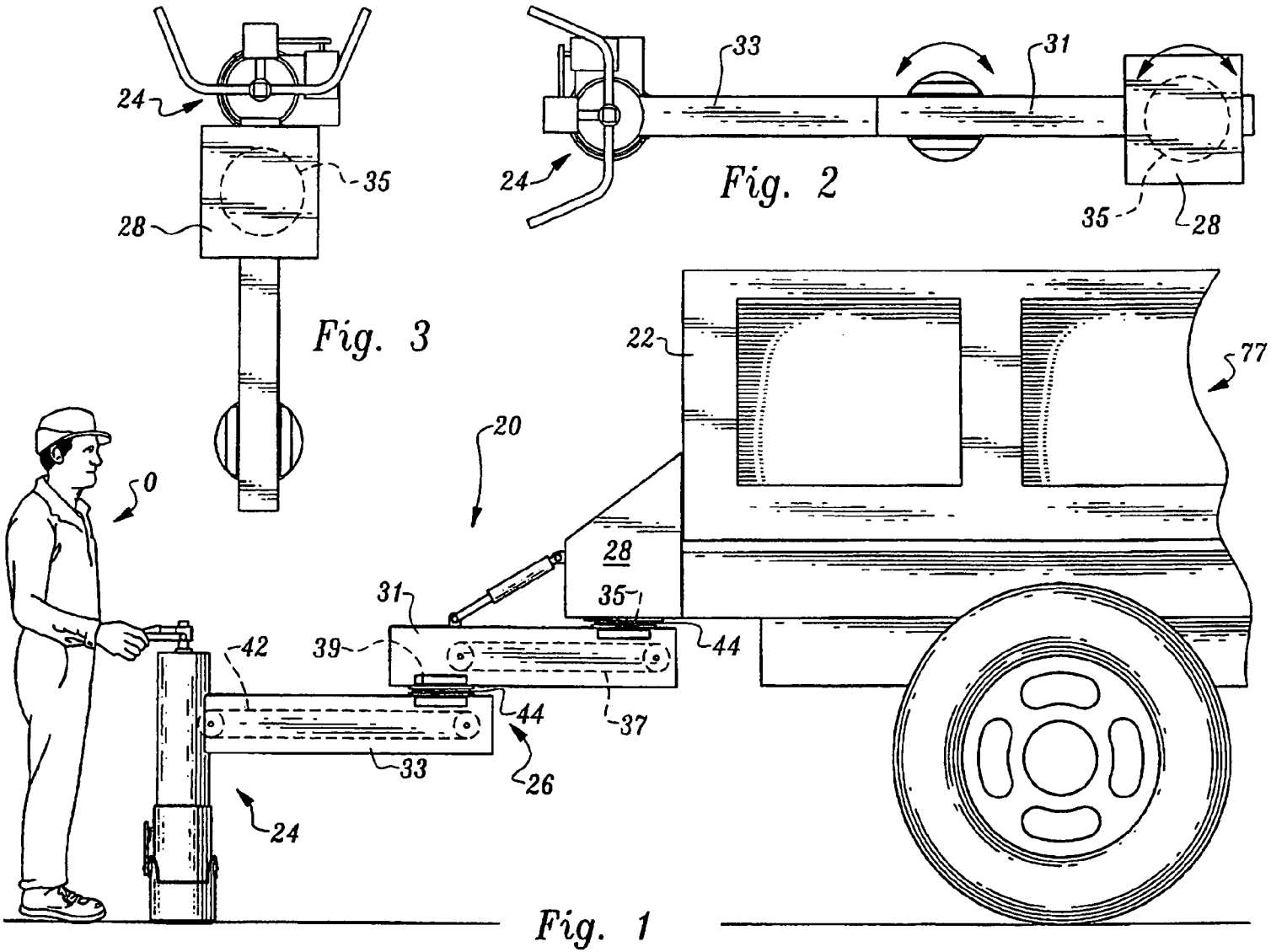
FIG. 1 is a pictorial representation of a worker using the patching device of the present invention, which is affixed to the rear of a motor vehicle, and which has been extended to reach an area of an asphalt roadway in need of a patch.
FIG. 2 is a top plan view of the patching device of the present invention, fully extended to repair or patch an anomaly in an asphalt roadway.
FIG. 3 is a top plan view of the asphalt dispensing and finishing section of the patching device of the present invention as shown in FIG. 1.

With reference now to the drawings, and initially to FIG. 1, an asphalt patching machine, constructed in accordance with the present invention, is shown at 20.

In order to ensure optimum utility and portability, the patching machine 20 is mountable to a motor vehicle, such as a truck T. The truck T preferably has a bed, or bin, 22 in which asphalt is provided for supplying that product to the machine 20.

Still referring primarily to FIG. 1, the versatility of the machine of the present invention will become apparent as an effective tool in the field. The improved patching machine, when rotatably mounted to a vehicle such as the truck T, is collapsible along the side of the vehicle for transporting it to an effected site. Once the truck T is within proximity of the effected area to be patched, the machine is extensible as seen in FIG. 1, and rotatable in substantially the plane of the roadway to be patched.

The improved asphalt patching machine of the present invention comprises a dispensing and finishing assembly 24 disposed at the end of the delivery assembly 26. A hopper 28 is affixed, by any suitable means, to the truck bin 22, where it is situated to receive asphalt material therefrom. The delivery assembly comprises at least two conveyor sections 31 and 33. An opening 35 at the base of the hopper 28, feeds material into the conveyor section 31, where it is transported by a belt, other suitable delivery means, 37 to an opening 39, where the material falls to the conveyor section 33 and on to a belt 42. The belt 42 thereafter delivers the patching material to the dispensing and finishing assembly 24. Suitable motors are provided to drive the belts on command.

The utility of the conveyor system is greatly enhanced by providing the mounting between the hopper and the conveyor section 31, and the mounting between the conveyor sections 31 and 33 are each provided with circular bearings 44 which permits relative rotation between those elements. Accordingly, the vehicle T can be parked within proximity of the effected area to be patched and the dispensing and finishing assembly moved to the effected area and located immediately over the area to be patched. Moreover, where the area to be patched is larger than the dispensing and finishing assembly 24, it is laterally moveable over the entire area without the necessity of moving the vehicle T. It will be appreciated that while a belt conveyor is illustrated, other conveyor systems, such as an auger system, may be employed without departure from the invention.

The dispensing and finishing assembly 24 is at the heart of the patching machine 20. Its function is to deposit patching material at the precise location of the effected area, i.e., a pothole crack or other anomaly in an asphalt roadway or drive, and thereafter to finish the material so as to make it compatible with the existing roadway.

Figure 6:
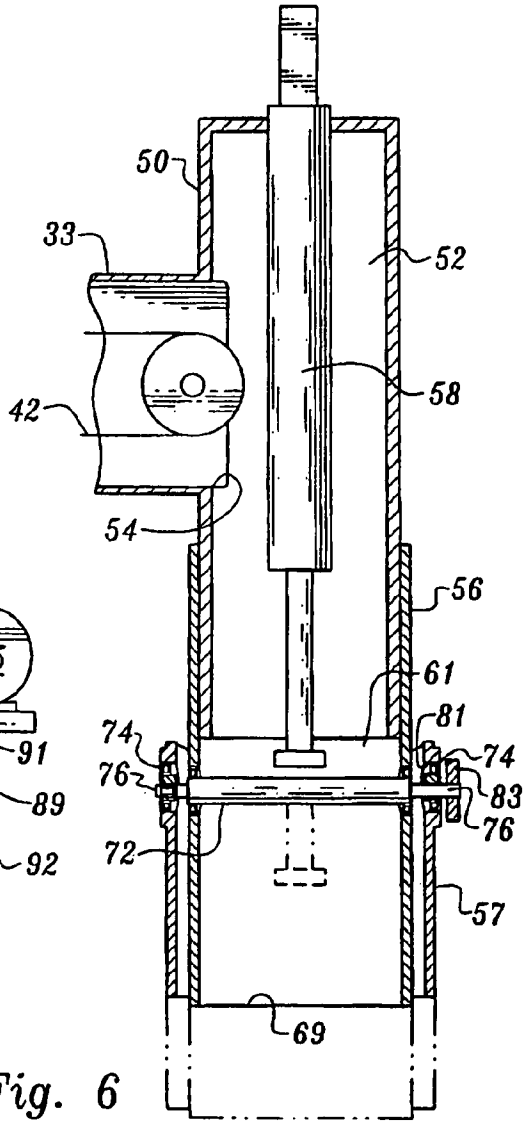
FIG. 6 is a view similar to that of FIG. 5, sectioned to show the internal mechanism.
Figure 5:
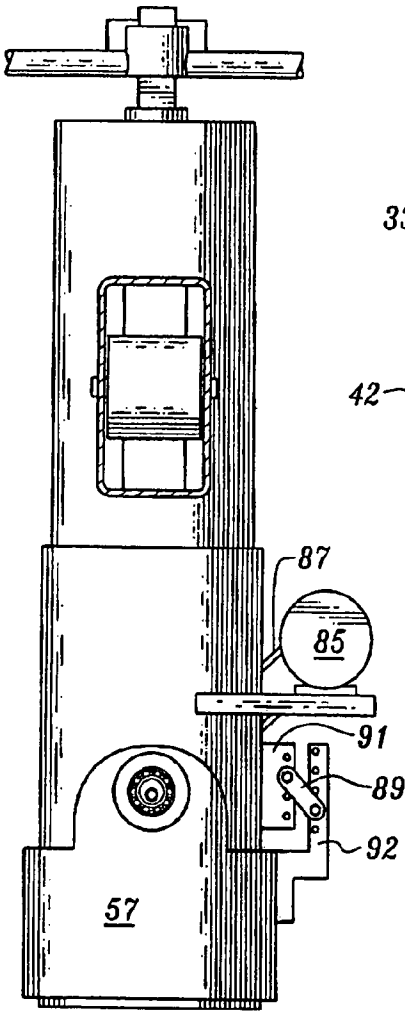
FIG. 5 is a side elevation of the section shown in FIG. 4.
Figure 4:
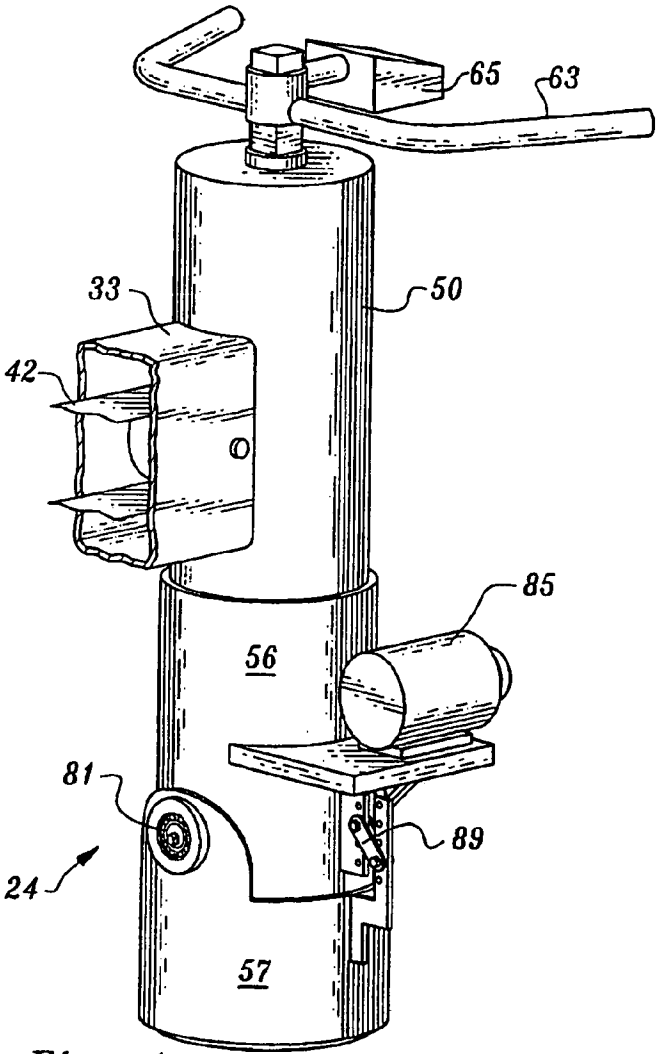
FIG. 4 is an enlarged perspective view of the section of the device shown in FIG. 3 with the asphalt delivery section of the patching device.
Figure 7:
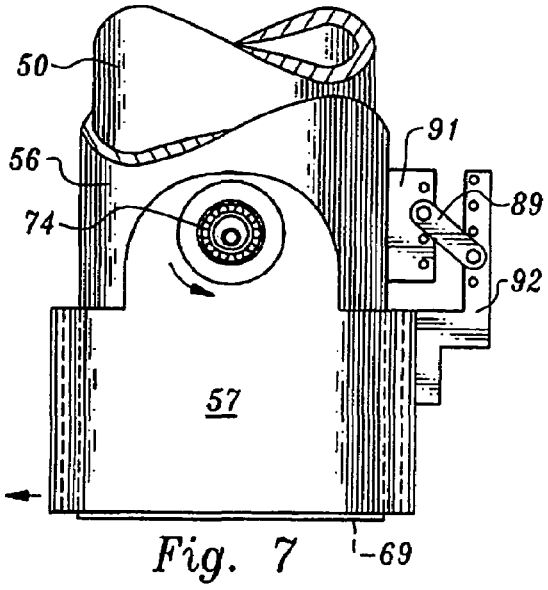
FIGS. 7 through 10 are side elevations, partially sectioned, showing the operation of the tamping component of the patching device of FIG. 1.
Figure 8:
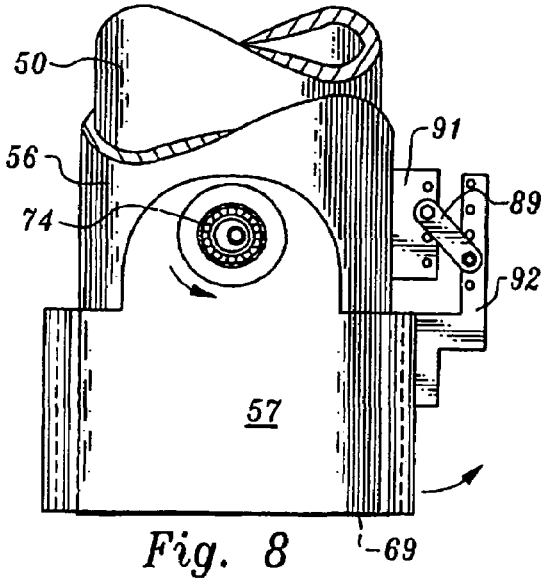
Figure 9:
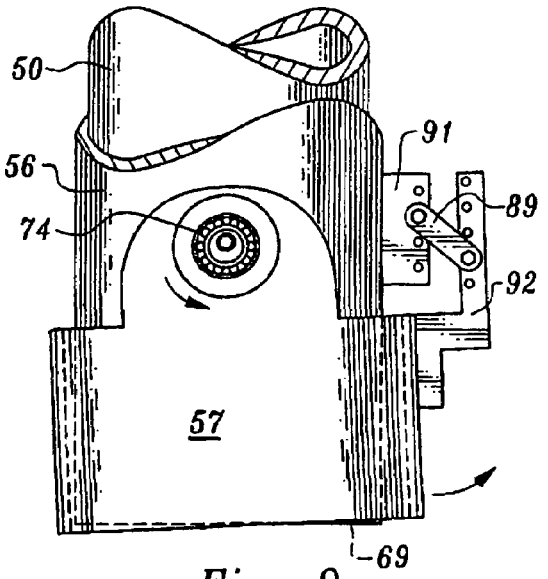
Figure 10:
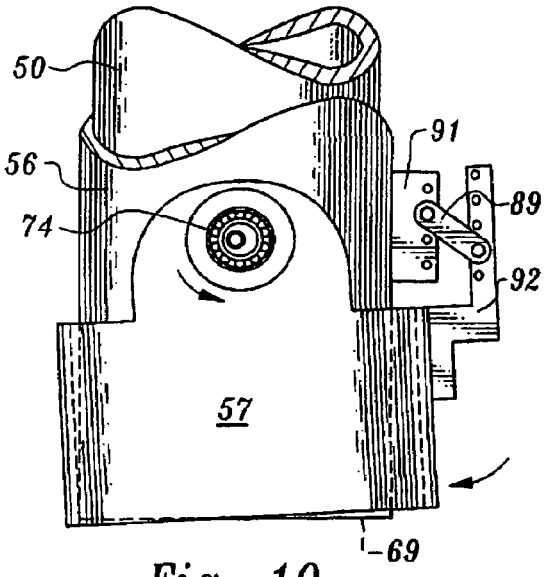

To this end, focus is now placed on FIGS. 4 through 6, which detail the structure of the assembly 24. Referring first to FIG. 4, a series of telescoping elements are seen, the first of which is a receiving element 50. The receiving element defines an interior cavity 52 and is integrated into the conveyor system with the conveyor section 33 mounted to the receiving element 50 by any suitable means, such as welding. The belt 42 delivers patching material to the cavity 52 through an opening 54 in the side wall of the receiving element 50.

The receiving element 50 exhausts the material to a delivery sleeve 56 which is telescopingly received about the receiving element 50, where it is capable of being raised and lowered by suitable means such as a hydraulic ram 58. The ram 58 acts on a cross member 61 which is secured to the delivery sleeve to move the sleeve by a controlled amount as determined by an operator O, who during operation of the machine is provided with control bars or guides 63, and control panel 65, immediately above the dispensing and finishing assembly 24. The control panel is operably interspersed between one or more power sources and the various driving motors which operate the system to selectively actuate them.

By actuating the ram from the control panel, the operator is able to lower the sleeve 56 to a position in immediate proximity to the effected area, and optimum material can be accurately delivered to the exact location in need of such material.

Once the asphalt patching material is delivered to the effected area, the final step, in accordance with the invention, is to finish the patch. The finishing process entails the expungement of excess moisture and the leveling of the patch to effect a smooth transition and seal between the patch and existing roadway asphalt. The finishing process can be accomplished in a couple of ways, one of which is illustrated in FIGS. 1 through 11.

Referring to FIGS. 4 and 6, a tamper 67 is provided about the lower extremity 69 of the delivery sleeve 56. The tamper 67 is fitted about the sleeve 56 and is held in place by a shaft 72 which spans the diameter of the delivery sleeve where it is mounted in the side wall thereof on bearings 74, which permit it to be rotated. The ends 76 protrude beyond the delivery sleeve 56 and are formed, or otherwise provided, with eccentrics 78 which engage the tamper through openings 81.

In order to rotate the shaft 72, a suitable motive force is provided. By way of example, a sheave 83 is mounted to one of the shaft ends 76. A power source, such as an electric motor 85, connects to the shaft 72 by means of a belt 87 about the sheave 83. Rotation of the shaft results in reciprocation of the tamper. Alternatively, a motor may be directly attached, by any suitable means, directly to the shaft 72.

The operator O first actuates the conveyor system to cause patching material to be deposited in the effected area. The patching material is delivered to the delivery sleeve where it drops, such as by gravitationally to the effected area of the roadway. By lowering the delivery sleeve, which also lowers the tamper to the material deposited into the effected area, the reciprocal action of the tamper is actuated by the motor. As the shaft 72 rotates, the eccentrics cause the tamper to go up and down on the patch, which packs the patch material.

Further, in keeping with the invention, the stroke and position of the tamper is controlled by a strap 89 mounted between the sleeve 56 and the tamper 57 by means of mounts 91 and 92, respectively.

Figure 11:
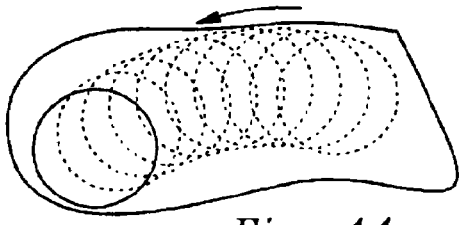
FIG. 11 is a pictorial representation of the asphalt patch effected by the tamping component of FIGS. 7 through 10.

Openings 94 in the mounts 91, 92 permit adjustment of the stroke along one side of the tamper. As a consequence, and with reference to FIGS. 7 through 10, the tamper will literally "walk" across the patch. By manipulating the control bars 63, the operator controls the path of the tamper, permitting uniform finishing of the patch. FIG. 11 graphically illustrates the path of the tamper as it finishes the patch. It will be apparent from the tamper's pattern that the patch can be leveled to be compatible with the roadway, making a motorist's transition over the patch relatively smooth.

Figure 13:
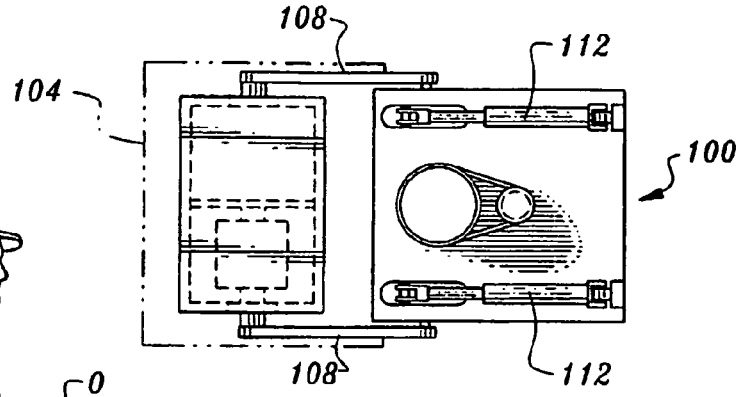
FIG. 13 is a top plan view of the asphalt patching device of FIG. 12.
Figure 12:
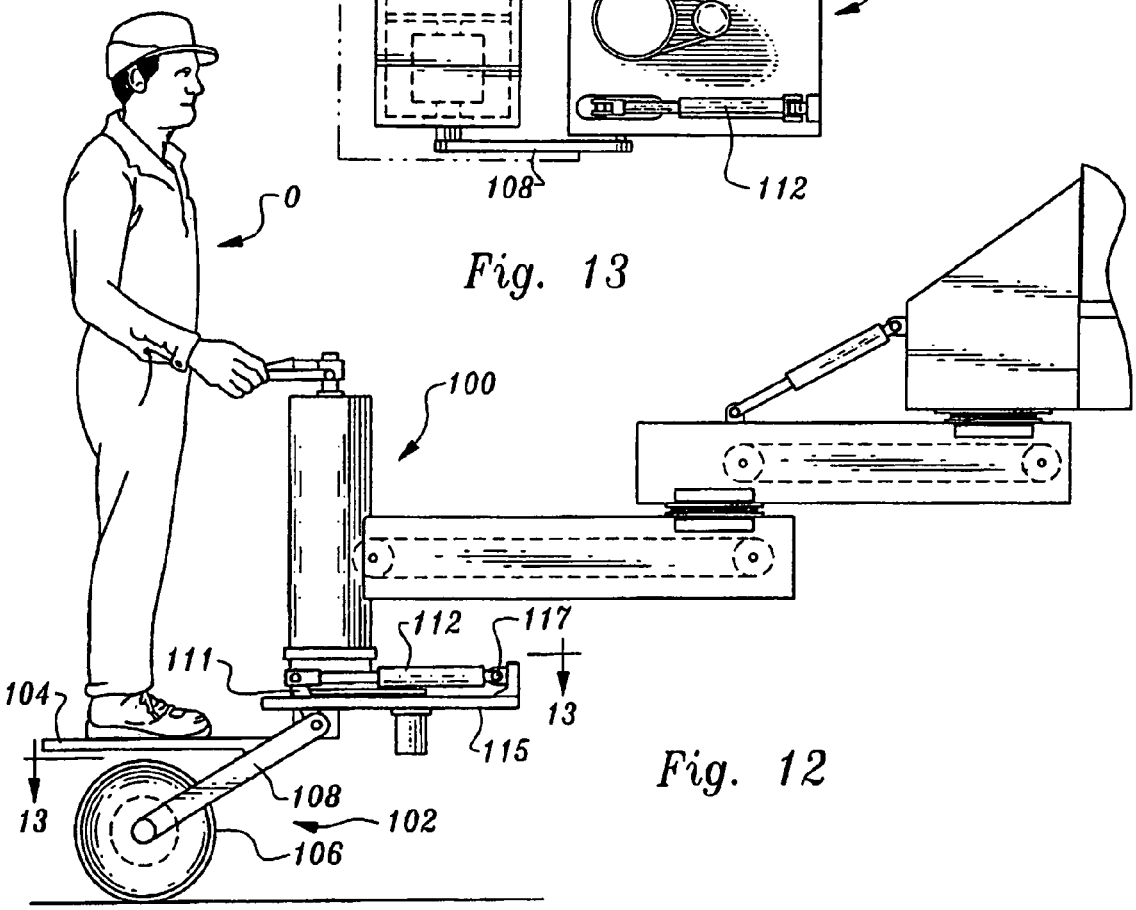
FIG. 12 is a pictorial representation similar to that of FIG. 1, except that a roller component is provided in lieu of a tamping component.
Figure 14:
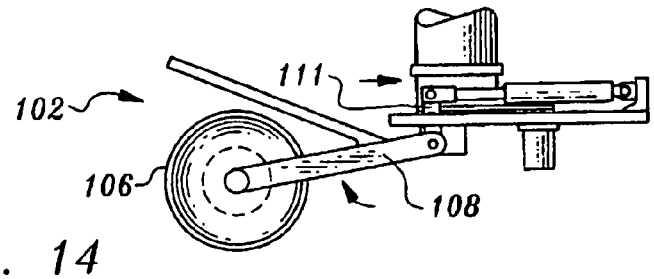
FIG. 14 is an enlarged view of the roller component of the device of FIG. 12.

With reference now to FIGS. 12 through 14, the present invention provides an alternative to the tamper of FIG. 1. Specifically, and referring to FIG. 12, while the conveyor system 26 is substantially the same in basic function to that described above, a simplified dispensing and finishing system is possible under this embodiment. Referring to FIGS. 12 and 14, a roller system 100 is illustrated. A delivery sleeve 56, as in the case of the FIG. 1 embodiment, receives patching material via the conveyor system, where it is deposited in the effected area of a roadway, or other area in need of an asphalt patch.

Once deposited, the operator O, who in this embodiment is standing on a small platform 104, the patch is ready to be finished. For this purpose, a roller 106 is mounted on an arm 108 beneath the platform 106. The arm 108 is linked by a bar 111 to a motor such as hydraulic motor 113. The motor 113 is anchored to a platform 115 by an anchor pin 117. The foregoing arrangement permits the operator to actuate the motor 113 to raise the roller for transportation and lower the roller 106 to compress and smooth out the patch by moving the roller over and about the patch under the control of the operator, who, by manipulating the control bars 63.

It will be appreciated that some variation in specific elements and arrangements thereof may vary from those illustrated and described without departure from the invention, which is described in the following claims:

The invention claimed is:

1. An asphalt patching machine for delivering and finishing asphalt material in an effected area of a roadway, said asphalt patching machine being attachable to a vehicle having a supply of patching material stored thereon;

said patching machine having a dispensing and finishing assembly for depositing and finishing patching material from the vehicle to the effected area of roadway;

a conveyor system disposed between the supply of patching material and said dispensing and finishing assembly; said conveyor system having at least two conveyor sections, said conveyor sections being connected to one another and the vehicle so as to be rotatable relative to one another and the vehicle in a plane substantially parallel to the roadway;

said dispensing and finishing assembly being attached to said conveyor, and including a receiving element; a delivery element; and a tamper, said tamper being telescopingly received about an end of said receiving element, said tamper being mounted about a delivery sleeve, a transfer shaft extending through said tamper and said delivery sleeve, eccentrics disposed on said shaft such that rotation of said shaft will cause said tamper to reciprocate to tamp down material delivered to the effected area, said conveyor delivering patching material to said receiving element where it drops to the effected area, said tamper being reciprocable to tamp down and finish the material so deposited, and movable over the effected area.

2. The asphalt patching machine of claim 1, wherein bearings are interposed between each said conveyor section and between said conveyor section and said supply of said patching material to facilitate relative rotation of said conveyor sections.

3. The asphalt patching machine of claim 1, wherein each said conveyor section has a separate conveyor, said conveyors delivering material from said supply of patching material to said dispensing and finishing assembly.

4. The asphalt patching machine of claim 1, wherein bars are secured to said receiving element, said bars being manually manipulatable to move said dispensing and finishing assembly into and about the effected area of a roadway, and a control panel disposed in close proximity to said bars, said control panel permitting operation of the various driving elements which move a supply of patching material to the effected area and tamp the material so delivered to patch the effected area.

5. The asphalt patching machine of claim 1, wherein a strap is secured between said delivery element and said tamper, said strap being adjustable to control the stroke of said tamper, and causing said tamper to work across the path.

6. The asphalt patching machine of claim 5, wherein the relative position of said strap between said delivery element and said tamper being adjustable.

7. The asphalt patching machine of claim 6, wherein said bars permitting movement of said patching machine in a generally parallel direction relative to said roadway.

8. The asphalt patching machine of claim 5, said strap being vertically disposed along one side of said delivery sleeve and said tamper, whereby operation of said tamper causes said dispensing and finishing assembly to move across the surface of the said patching material so deposited.

9. The asphalt patching machine of claim 1, wherein said patching machine is generally collapsible to a transport position adjacent the vehicle.

10. An asphalt patching machine for delivering and finishing asphalt material in an effected area of a roadway, said asphalt patching machine being attachable to a vehicle having a supply of patching material stored thereon;

said patching machine having a dispensing and finishing assembly for depositing and finishing patching material from the vehicle to the effected area of roadway;

a conveyor system disposed between the supply of patching material and said dispensing and finishing assembly; said conveyor system having at least two conveyor sections, said conveyor sections being connected to one another and the vehicle so as to be rotatable relative to one another and the vehicle in a plane substantially parallel to the roadway;

said dispensing and finishing assembly being attached to said conveyor, and including a delivery sleeve and a tamper telescopingly received thereabout, a transfer shaft extending through said tamper and said delivery sleeve, eccentrics disposed on said shaft such that rotation of said shaft will cause said tamper to reciprocate to tamp down material delivered to the effected area; a roller; said roller attached to said delivery and finishing assembly; said roller being movable over the patching material to finish the patch.

11. The asphalt patching machine of claim 10, wherein a platform is provided disposed above said roller whereby an operator may ride as the roller is moved across the effected area to finish said patch.

12. The asphalt patching machine of claim 10, wherein bearings are interposed between each said conveyor section and between said conveyor section and said supply of said patching material to facilitate relative rotation of said conveyor sections.

13. The asphalt patching machine of claim 10, wherein each said conveyor section has a separate conveyor, said conveyors delivering material from said supply of patching material to said dispensing and finishing assembly.

14. The asphalt patching machine of claim 10, wherein said dispensing and finishing assembly comprises a series of elements, said elements being telescopingly received in one another and comprising a receiving element for receiving material from said conveyor, a delivery sleeve for delivering material to the effected area, and a roller, said delivery sleeve being telescopingly received about said receiving element, and said roller being mounted adjacent the free end of said delivery sleeve for tamping down material delivered to the effected area.

15. The asphalt patching machine of claim 10, wherein bars are secured to said receiving element, said bars being manually manipulatable to move said dispensing and finishing assembly into and about the effected area of a roadway, and a control panel disposed in close proximity to said bars, said control panel permitting operation of the various driving elements which move a supply of patching material to the effected area and roll the material so delivered to patch the effected area.

16. The asphalt patching machine of claim 10, wherein said patching machine is generally collapsible to a transport position adjacent the vehicle.

17. The asphalt patching machine of claim 10, wherein bars are secured to said receiving element, said bars being manually manipulatable to move said dispensing and finishing assembly into and about the effected area of a roadway, and a control panel disposed in close proximity to said bars, said control panel permitting operation of the various driving elements which move a supply of patching material to the effected area and finish the material so delivered to patch the effected area.

* * * * *